US005259369A

United States Patent [19]

Matsumura et al.

[11] Patent Number: 5,259,369

[45] Date of Patent: Nov. 9, 1993

[54] REMEDIAL DEVICE FOR HAND INSUFFICIENCY

[75] Inventors: Mitsuma Matsumura; Kuniaki Shibuya, both of Tokyo, Japan

[73] Assignee: Nitto Kohki Co., Ltd., Tokyo, Japan

[21] Appl. No.: 713,838

[22] Filed: Jun. 12, 1991

[30] Foreign Application Priority Data

Jun. 13, 1990 [JP] Japan ..... 2-63055

[51] Int. Cl.[5] ..... A61H 1/02

[52] U.S. Cl. ..... 12/26; 128/24 R

[58] Field of Search ..... 128/24 R, 25 R, 26; 602/21, 22; 482/47, 48

[56] References Cited

U.S. PATENT DOCUMENTS

| | | | |
|---|---|---|---|
| 3,937,215 | 2/1976 | Barthlome | 128/26 |
| 4,274,399 | 6/1981 | Mummert | 128/26 |
| 4,522,197 | 6/1985 | Hasegawa | 128/26 |
| 4,596,240 | 6/1986 | Takahashi et al. | 128/26 |
| 4,619,250 | 10/1986 | Hasegawa | 128/26 |
| 4,807,606 | 4/1989 | Hasegawa et al. . | |

FOREIGN PATENT DOCUMENTS

| | | | |
|---|---|---|---|
| 62-54505 | 11/1987 | Japan . | |
| 2-11071 | 3/1990 | Japan . | |
| 2-15471 | 4/1990 | Japan . | |
| 2008957 | 6/1979 | United Kingdom | 128/26 |
| 2126110 | 3/1984 | United Kingdom . | |
| 2147812 | 5/1985 | United Kingdom . | |

*Primary Examiner*—Richard J. Apley
*Assistant Examiner*—Linda C. M. Dvorak
*Attorney, Agent, or Firm*—Wenderoth Lind & Ponack

[57] ABSTRACT

A remedial device for hand insufficiency includes a device body having an obverse surface and a reverse surface, a compressed air supply source and an air supply-discharge hose interconnecting the device body and the compressed air supply source. Each of the obverse and reverse surfaces of the device body is provided thereon with a plurality of air sacks inflated and shrunken by the action of compressed air supplied and discharged for expanding and elongating the fingers and for elongating the wrist and arm joint. The air supply-discharge hose constitutes an air supply-discharge circuit provided with two branched circuits for compressed air which are disposed independently on an air supply-discharge side for the air sacks for elongating and expanding the fingers and on an air supply-discharge side for the air sacks for elongating the wrist and arm joint. The two branched circuits are provided each with switchable distribution device for selectively supplying and discharging compressed air to and from one or both of the branched circuits.

3 Claims, 5 Drawing Sheets

REMEDIAL DEVICE FOR HAND INSUFFICIENCY

BACKGROUND OF THE INVENTION

1. Field of the Invention

The present invention relates to a remedial device for hand insufficiency, which is capable of remedying functional disorders of the arm joints, hands and fingers attendant on diseases and injuries of the central nervous system such as cerebral blood vessel injuries, external cerebral injuries, cerebral palsy and spinal injuries, on injuries to the peripheral nervous system and on injuries to the joints and muscles.

2. Description of the prior Art

When the aforementioned diseases and disorders induce functional disorders in the forearms, arm joints, hands and fingers, patients are required to receive therapy and, at the same time, take physical training for restoration of motile functions. It has been long held that restoration of the functions of the arm joints, hands and fingers from the diseases and disorders is extremely difficult. In spite of the numerous studies conducted to date in the field of medical rehabilitation, a fully satisfactory remedial device remains yet to be developed. An attempt at enabling the arm joint, hand or finger paralytically bent or contracted or incapacitated for extension to be extended by the pressure of air or the action of a spring, for example, fails to yield satisfactory results.

Under these circumstances, further improved remedial devices have been proposed in Japanese Patent Publication No. 62-54505, Japanese Utility Model Publication No. 2-15471 and Japanese Utility Model Publication No. 2-11071. These prior art remedial devices use a main body composed of a flat palmate cloth (basal fabric), finger retainers for individually retaining the five fingers of a hand so as to facilitate insertion of paralitically bent or contracted fingers, and weblike air sacks interposed one each between the adjacent finger retainers and adapted to cause the fingers to be spread apart. Thus, the prior art remedial devices manifest an epochal effect in improving the functions of the fingers, etc. by enabling the fingers to be extended and, at the same time, spread apart efficiently. They are gaining high esteem in the field of medical therapy.

For the functional disorders of arm joints, hands and fingers due to diseases of the central nervous system such as disorders of the cerebral blood vessels, the simultaneous training and exercise of such arm joints, hand joints and fingers manifests a conspicuous effect in improving their functions. However, the simultaneous training and exercise are not always required for all the diseases and disorders under discussion.

Fingers sustaining partial injuries, for example, require the exercise of extending and expanding the fingers. For the improvement of their functions, the exercise of elongating the wrist is not only unnecessary but also rather detrimental than beneficial. For hands sustaining functional disorders due to chronic arthrorheumatism, the exercise of extending and rearward flexing of hand joints is effective and the exercise of elongating and spreading fingers is not necessary.

For the solution to the problems of this nature, however, the aforementioned prior art references only go to the length of teaching the stoppage of supply of compressed air to be effected by squeezing air conduits interconnecting the compressed air source to the individual air sacks with a pinch valve or clip. For this reason, the remedial devices disclosed in these references are incapable of providing delicate treatments befitting various internal and surgical symptoms.

OBJECTS AND SUMMARY OF THE INVENTION

The present invention has been accomplished to solve the problems mentioned above.

The main object of the present invention is to provide a remedial device for fingers, etc. which is able to cope with various functional disorders and to be handled easily by trainers and patients.

To accomplish the objects described above, according to the present invention there is provided a remedial device for hand insufficiency, comprising a device body provided on each of the obverse and reverse surfaces thereof with a plurality of air sacks inflated and shrunken by the action of compressed air supplied and discharged for spreading and elongating the fingers and for elongating the wrist and arm joint, a compressed air supply source, and an air supply-discharge hose interconnecting the device body and the compressed air supply source, the air supply-discharge hose constituting an air supply-discharge circuit provided with two branched circuits for compressed air disposed independently on an air supply-discharge side for the air sacks for elongating and expanding the fingers and on an air supply-discharge side for the air sacks for elongating the wrist and arm joint, the two branched circuits each provided with switch distribution means for selectively supplying and discharging compressed air to and from one or both of the two branched circuits.

A trainer or patient fixes the device body at the site requiring therapy such as the hand, wrist or arm and, by operating the switch distribution means disposed in the air supply-discharge circuit in accordance with the degree of functional disorder and the symptoms, decides preparatorily the kind of exercise the patient desires to make at the site.

When compressed air is supplied through the air supply-discharge hose to the plurality of air sacks formed on the device body, the air sacks are inflated to induce forced spreading and extension at the site of the hand, wrist or arm fixed tightly to the device body. The supply of the compressed air is carried out for a relatively short time. When the compressed air is forcibly or spontaneously discharged after the elapse of a prescribed length of time, the fingers are allowed to resume their original state from their extended and expanded state and the wrist or arm joint is allowed to resume its original state from its extended state. This exercise of expansion and extension is carried out periodically and is repeated ten-odd times to twenty-odd times. At times, the supply of the compressed air is carried out for a relatively long time. When the patient is accustomed to this exercise, the number of repetitions of the air supply-discharge cycle is increased.

These repetitions of the exercise allow the patient to develop the autokinetic ability to stretch and bend his fingers, wrist and arm joint at his own will. This autokinesis gradually revives the paralyzed cerebral function.

The above and other objects, characteristic features and advantages of the present invention will become more apparent to those skilled in the art as the disclosure is made in the following description of a preferred embodiment of the invention, as illustrated in the accompanying drawings.

DETAILED DESCRIPTION OF THE PREFERRED EMBODIMENTS

The present invention will now be described with reference to the illustrated embodiment.

Figure 1:
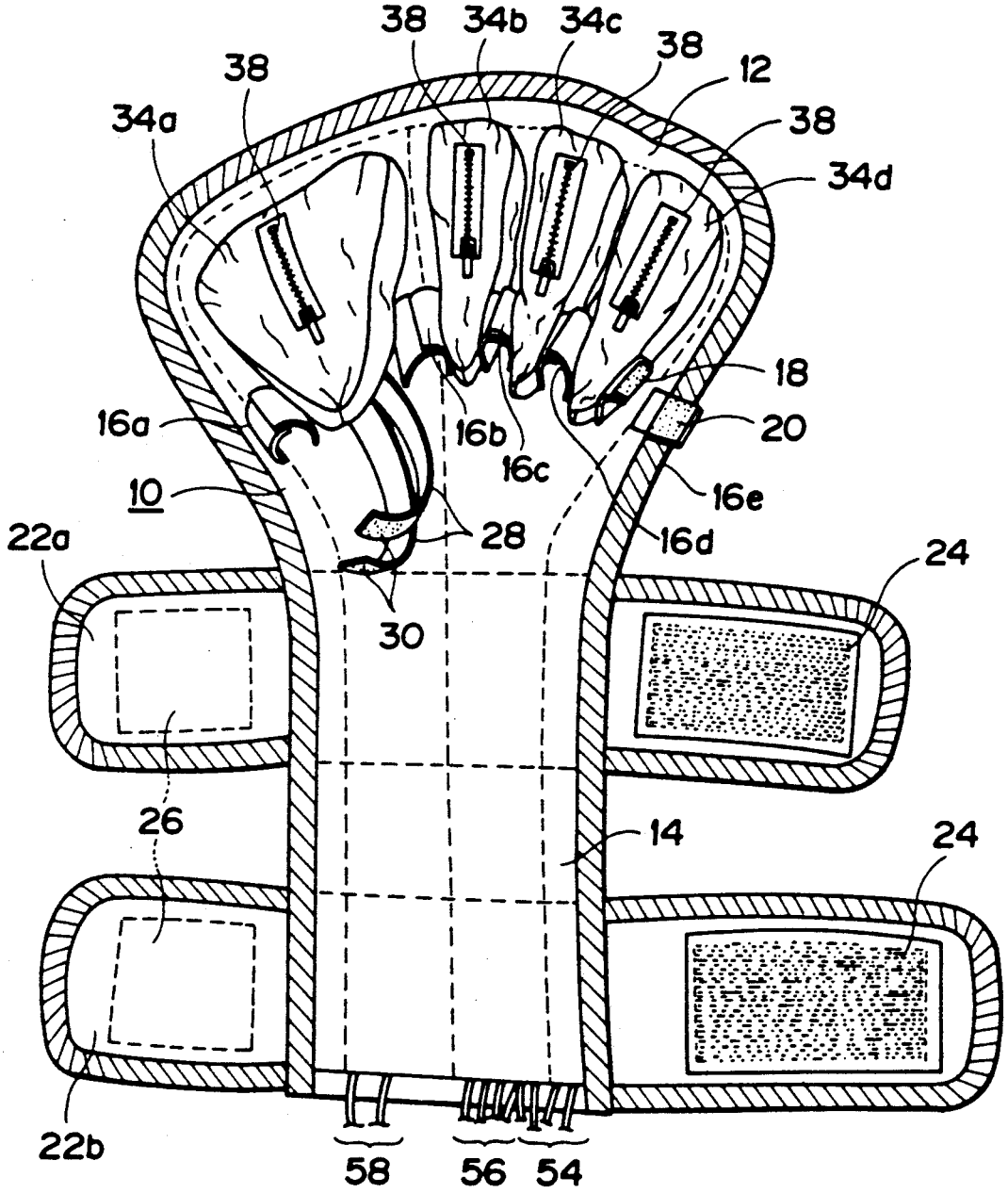
FIG. 1 is a rear view illustrating a device body of one embodiment of the remedial device for hand insufficiency according to the present invention when viewed from the upper side of a hand.

FIG. 1 is a rear view illustrating the remedial device for hand insufficiency according to the present invention adapted for use on a right hand.

The remedial device of the present invention is identical with the conventional ones in respect that it is provided with a basal cloth 10 and air sacks disposed on the front and back surfaces thereof. The basal cloth 10 is composed of two parts, a flat palmate cloth part 12 formed in a shape and size large enough to cover the entire surface of a palm with the five fingers spread out and a flat forearm cloth part 14 extending integrally from the base of the palmate cloth part 12 and formed in a shape and size conforming to the inner arm surface of the wrist and the forearm. The basal cloth 10 is cut in a size conforming to the hand of an average healthy man as the standard. This basal cloth 10 is formed of woven fabric or knit fabric, non-woven fabric or synthetic resin sheet having good air permeability, or a flexible material soft and agreeable to the touch.

As illustrated in FIG. 1, finger retainers 16*a*, 16*b*, 16*c*, 16*d* and 16*e* provided with a freely openable and closable velcro fastener are attached at prescribed positions on the upper side of the palmate cloth part 12 so that the five fingers of the hand in a spread state can be separately attached to the prescribed positions on the flat palmate cloth part 12. These finger retainers 16*a*, 16*b*, 16*c*, 16*d* and 16*e* are each formed of a pair of ribbons. A loop element 18 of the velcro fastener is disposed at the free end of one of each pair of ribbons and a hook element 20 of to velcro fastener at the free end of the other of the pair of ribbons, so that the paired ribbons can be joined end to end to form loops.

A wrist retainer 22*a* and an arm retainer 22*b* are attached to the forearm cloth part 14. These retainers 22*a* and 22*b* are each formed of a pair of ribbons, similarly to the finger retainers. In the same manner as in the finger retainers, a loop element 24 of the velcro fastener is attached to the free end of one of each pair of ribbons and a hook element 26 of the velcro fastener to the free end of the other of the pair of ribbons, so that the paired ribbons can be joined end to end to form loops.

One end of a retainer band 28 is attached to the root of the portion of the flat palmate cloth part 12 between the thumb and the index finger (first finger) on the upper side of the palmate cloth part 12. When this retainer bands 28 is passed around the upper side of the hand, a hook element 30 of the velcro fastener attached to the free end of the retainer band 28 can be joined to a loop element 32 of the velcro fastener attached to the outer surface of the ribbon of the wrist retainer 22*a* to increase the fastness of contact between the palm and the basal cloth 10.

Delta-shaped pockets 34*a*, 34*b*, 34*c* and 34*d* are cubically formed and diverged in the pattern of a delta in the direction of the finger tip in conformity to the sizes of the portions of the flat palmate cloth part 12 between the adjacent fingers, with the bases thereof positioned along the portions intervening between the finger retainers 16*a*, 16*b*, 16*c*, 16*d* and 16*e* in order for the five fingers to be kept spread apart. In these pockets, first air sacks 36*a* or 36*b* which can be inflated and shrunken by supply and discharge of compressed air as illustrated in FIGS. 3(*a*) and 3(*b*) are accommodated one each. The first air sacks 36*a* and 36*b* are formed of a suitable airtight sheet material such as a plastic sheet material and, while in a shrunken state, assume a flat triangular shape as illustrated in FIGS. 3(*a*) and 3(*b*) in the pockets 34*a* to 34*d*. The first air sack 36*a* illustrated in FIG. 3(*a*) is intended for use in the portion between the thumb and the first finger and the first air sacks 36*b* illustrated in FIG. 3(*b*) are for use in the portions between the first finger, middle finger (second finger), ring finger (third finger) and little finger (fourth finger). The first air sack 36*a* for use in the large portion between the thumb and the first finger is larger than the other first air sacks 36*b*. When the first air sacks 36*a* and 36*b* are inflated by the supply of compressed air, therefore, the inner wall surfaces of the pockets 34*a* to 34*d* restrain the first air sacks from undue inflation and give them fixed shapes conforming to the shapes of the pockets 34*a* to 34*d*.

Denoted by reference numeral 38 is a zipper which is formed in each of the delta-shaped pockets 34*a*, 34*b*, 34*c* and 34*d* for allowing accommodation of the first air sacks 36*a* and 36*b* in the pockets.

Figure 2:
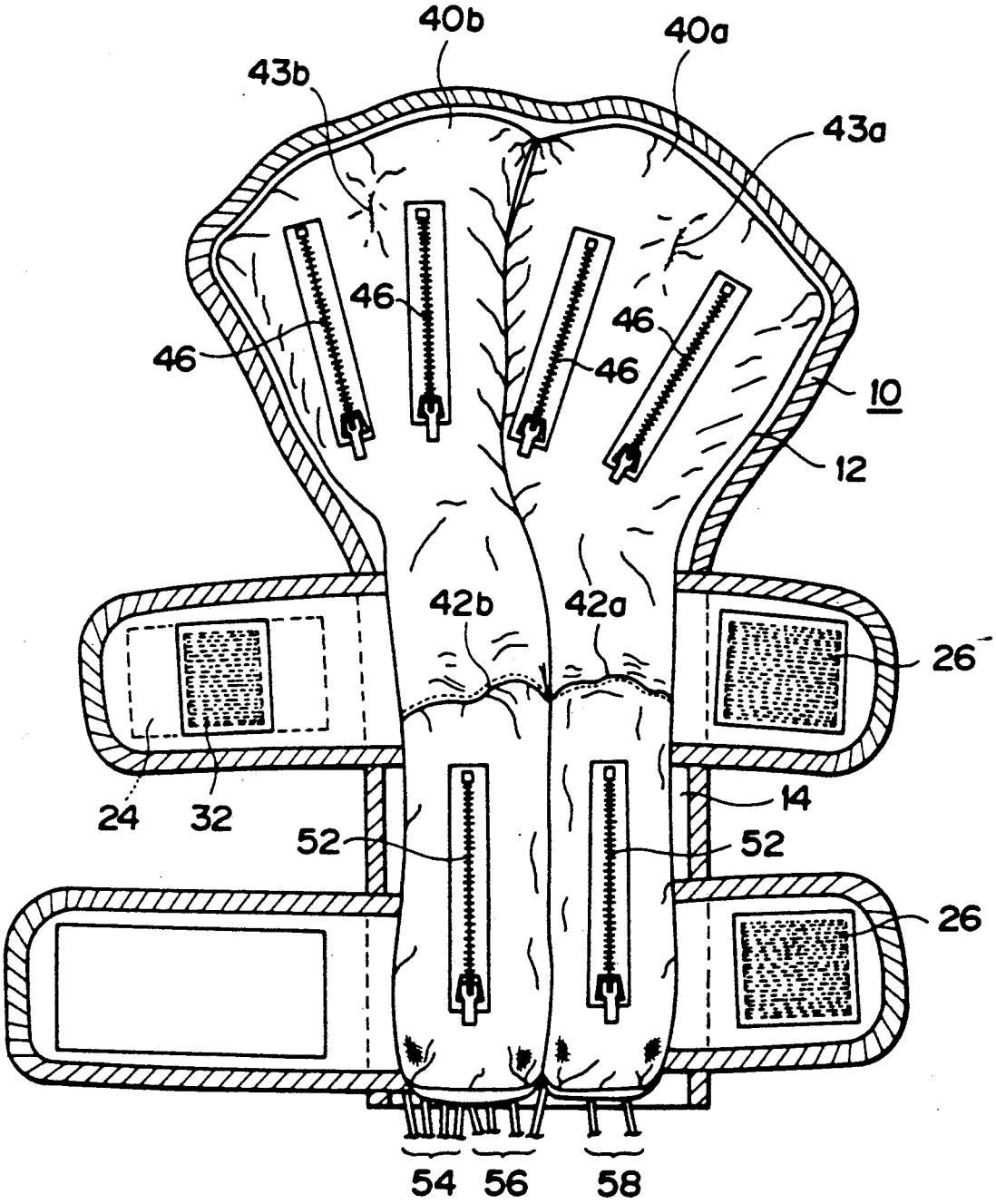
FIG. 2 is a front view of the device body when viewed from the palmate side.
Figure 3A:
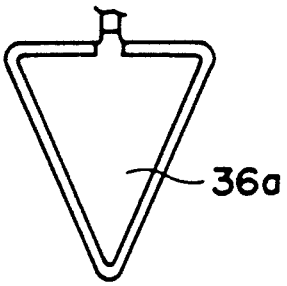
FIGS. 3(*a*) and 3(*b*) are plan views of first air sacks, FIG. 3(*c*) a plan view of a second air sack and FIG. 3(*d*) a plan view of a third air sack, all usable for the remedial device.
Figure 3B:
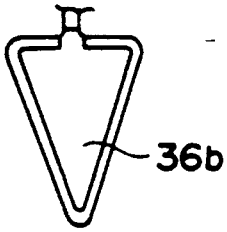
Figure 3D:
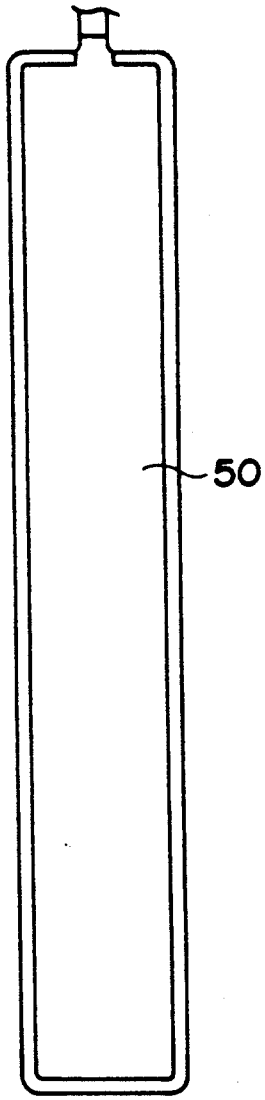
Figure 3C:
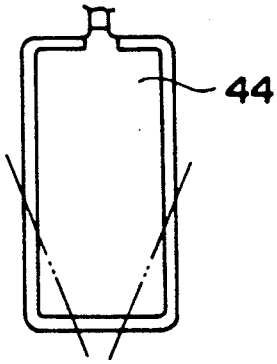

As illustrated in FIG. 2, on the front side of the basal cloth 10, a first pocket 40*a* covering from the thumb to the first finger and extending from the finger tips through the wrist and a second pocket 40*b* covering from the first finger to the fourth finger and extending from the finger tips through the wrist are formed, similarly to the first pocket 40*a*, with a soft material possessing no conspicuous extensibility and parallelly disposed substantially throughout the entire length in the longitudinal direction in the palmate cloth part 12. In the central parts of the pockets 40*a* and 40*b*, more specifically in the lateral parts thereof opposite to the wrist part, darts 42*a* and 42*b* are formed and cubically sewn for the purpose of enabling the two pockets to be easily folded in the shape of a spread V. When the first and second pockets 40*a* and 40*b* are inflated by the supply of compressed air to air sacks 50 which will be described more specifically hereinbelow, since these pockets are cubically sewn to be positively folded in the shape of spread V, the basal cloth 10 can be forcibly folded in the shape of spread V toward the upper side of the basal cloth.

In the leading end parts of the first and second pockets 40*a* and 40*b* closer to the finger tips, partitions 43*a* and 43*b* adapted to divide the leading end parts in half are respectively formed. In the inner leading end parts of the pockets, second air sacks 44 are accommodated one each in such a manner as to avoid dislocation. The second air sacks 44 are formed of the same plastic material as the first air sacks 36a and 36b and, while in a shrunken state, allowed to assume a flat rectangular shape as illustrated in FIG. 3(*c*). They are accommodated inside the pockets, with the two lower corners folded along the chain lines converging downwardly. When the second air sacks 44 are inflated by the supply of compressed air, therefore, the inner wall surfaces of the first and second pockets 40a and 40b and the second air sacks 44 adjoining them restrain the second air sacks 44 from inflating excessively and give them stable fixed shapes conforming to the shapes of the leading end parts of the pockets 40a and 40b closer to the finger tips.

The first and second pockets 40a and 40b are likewise separately openable and closable with zippers 46. The second air sacks 44 are inserted into and removed from the interiors of the pockets 40a and 40b by opening these zippers 46.

Further in the first and second air pockets 40a and 40b, third air sacks 50 are accommodated in conjunction with the second air sacks 44. These third air sacks 50, while in a shrunken state, are caused to assume a flat oblong shape as illustrated in FIG. 3(*d*) and are accommodated flatly inside the pockets 40a and 40b. When the third air sacks 50 are inflated by the supply of compressed air, therefore, the inner wall surfaces of these pockets and the second air sacks 44 adjoining them restrain the third air sacks from being inflated excessively and give them stable fixed shapes conforming to the shapes of the pockets 40a and 40b.

The third air sacks 50 are inserted into and removed from the interiors of the pockets 40a and 40b by opening zippers 52 disposed freely openably and closably in the portions of the first and second pockets 40a and 40b closer to the bases thereof.

Air conduits 54 are connected to the first air sacks 36a and 36b inside the delta-shaped pockets 34a and 34b, and air conduits 56 and 58 are connected to the second air sacks 44 and third air sacks 50 inside the first and second pockets 40a and 40b.

Figure 4:
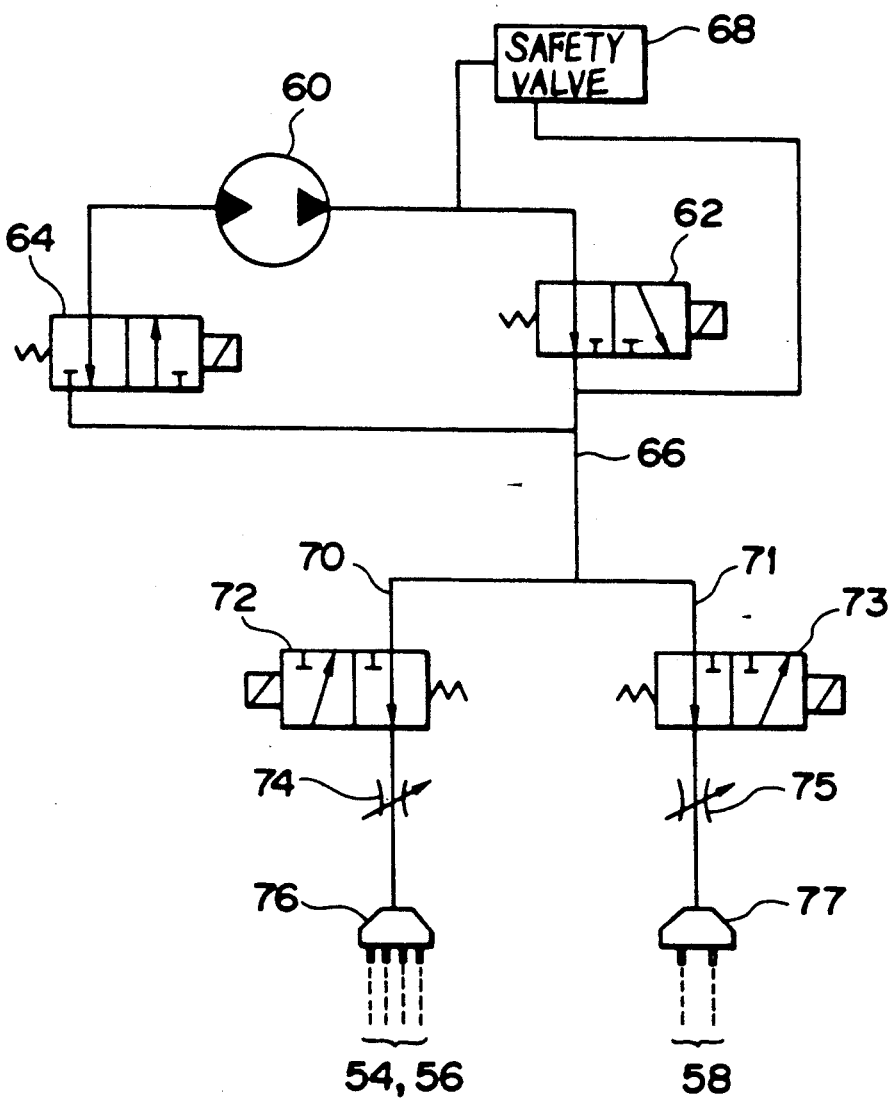
FIG. 4 is a circuit diagram illustrating means for switch distribution of compressed air by means of a solenoid valve.

FIG. 4 is a circuit diagram illustrating means for alternately or simultaneously distributing compressed air to the air sacks by means of solenoid valves. An air supply solenoid valve 62 is connected to the discharge outlet of a compressed air supply source 60 and an air discharge solenoid valve 64 to the suction outlet thereof. The supply source 60 and air conduits 54, 56 and 58 form a distribution circuit in conjunction with an air supply-discharge hose 66 provided with the solenoid valves 62 and 64 and a safety valve 68.

The side of the air supply-discharge hose 66 for connection to the air sacks is branched into two legs, i.e. a hose 70 connected to the conduit 54 to the first air sacks 36a and 36b and to the second air sacks 44 for extending and expanding fingers and a hose 71 connected to the conduit 58 to the third air sacks 50 for extending a wrist and arm joint. The hose 70 has a solenoid valve 72 and a pressure reducing valve 74 inserted therein and is provided in the terminal part thereof with a plug 76 to which air conduits 54 and 56 are connected. By the same token, the hose 71 has a solenoid valve 73 and a pressure reducing valve 75 inserted therein and is provided in the terminal part thereof with a plug 77 to which air conduits 58 are connected.

Figure 5:
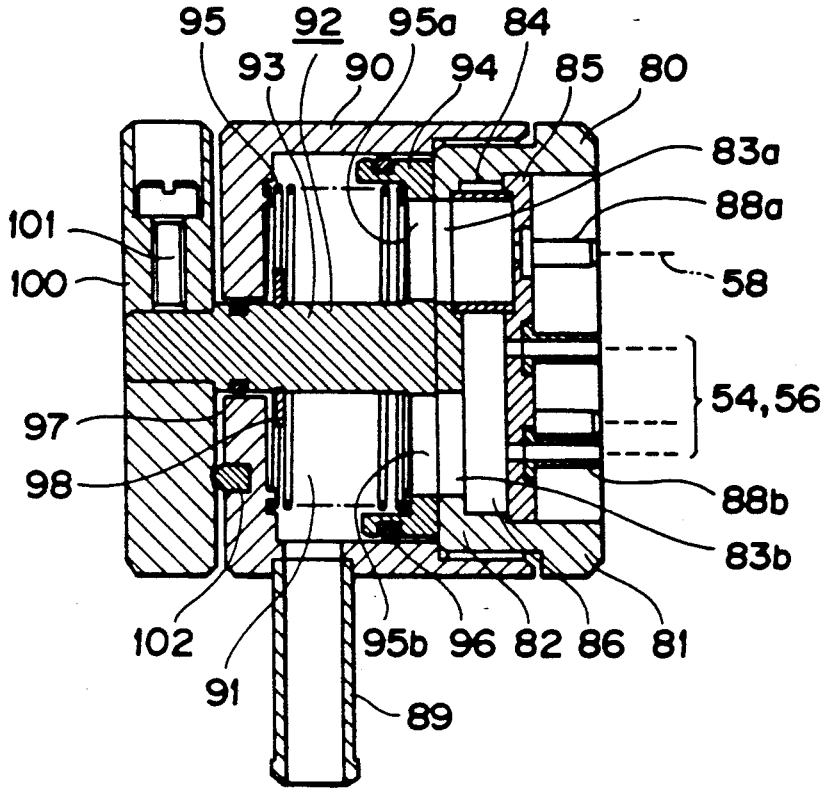
FIG. 5 is a longitudinally sectioned side view of a manually operated switch valve.

The switch distribution means may be replaced with a manually operated switch valve. FIG. 5 is a longitudinally sectioned side view of a switch valve usable as the switch distribution means in the remedial device of the present invention.

A short tubular stationary member 80 provided with an open end 81 and a closed end 82 has two through holes 83a and 83b disposed in the diametric direction in the closed end 82. A stationary disk 85 having a diameter equal to the inside diameter of the stationary member 80 is fitted in the stationary member 80. A communicating tube 84 equal in diameter to the through hole 83a is inserted and clamped between the stationary disk 85 and the closed end 82. An empty chamber 86 communicates with the through hole 83b and is partitioned by the communicating tube 84. On the side of the open end 81 of the stationary disk 85, a flow outlet 88a communicating with the communicating tube 84 and a flow outlet 88b communicating with the empty chamber 86 are provided.

Figures 6A, 6B, 6C:
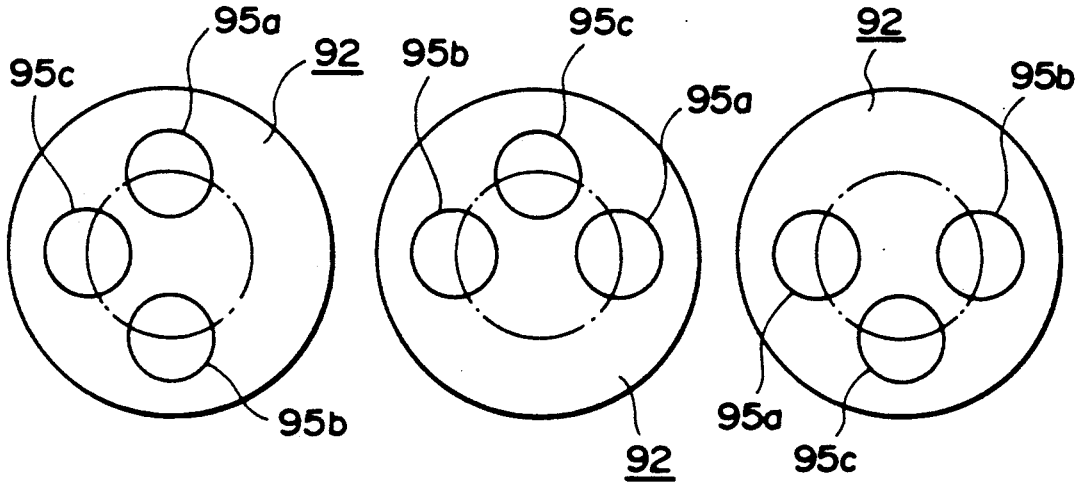
FIGS. 6(*a*), 6(*b*) and 6(*c*) are front views of a rotary member of the switch valve when viewed from a disk side.

The stationary member 80 is provided in the peripheral part of the closed end 82 thereof with a flow inlet 89 for compressed air. A cylindrical lid 90 having substantially the same diameter as the stationary member 80 is fitted in the flow inlet 89. The solenoid valves 62 and 64 of FIG. 4 are connected to the cylindrical lid 90 through the air supply-discharge hose 66. A piston-like rotary member 92 comprises a rotary shaft 93 extending through the cylindrical lid 90 in the axial direction and having a disk-like handle 100 fixed to one end thereof by means of a bolt 101, and a disk 94 formed at the other end of the rotary shaft 93 perpendicularly to the rotary shaft 93. The rotary member 92 is disposed slidably on the inner wall surface of the cylindrical lid 90 and, at the same time, urged toward the stationary member 80 by the biasing force of a compression coil spring 95. The disk 94 is accommodated inside the cylindrical lid 90 and held in contact with the closed end 82. In the disk 94, through holes 95a and 95b are formed at positions corresponding to the through holes 83a and 83b formed in the closed end 82 and, at the same time, a through hole 95c is formed on the circumference passing the two through holes 95a and 95b at a position equidistant from the two through hosles as illustrated in FIG. 6(*a*).

O-rings 96 and 97 are formed on the cylindrical periphery of the disk 94 and on the periphery of the rotary shaft 93 in the substantially central part in the axial direction thereof so as to seal airtightly a flow path 91 for compressed air formed inside the cylindrical lid 90.

An E-shaped retaining ring 98 is adapted to restrain the rotary shaft 93 from moving in the direction of the handle 100. A bullet-shaped stator 102 is adapted to stop the rotation of the handle 100 at angular intervals of 90 degrees. This stator 102 is disposed with almost half of its volume buried in the end part of the lid 90 on the side of the handle 100.

Now, the operation of the remedial device according to the present invention will be described.

To attach the remedial device to a hand, fingers, and a forearm sustaining functional disorders, the finger retainers 16a to 16e disposed on the upper side of the palmate cloth part 12 and the wrist and arm retainers 22a and 22b disposed in the forearm cloth part 14 are widened, the upper side of the palmate cloth part 12 is applied to the deformed or contracted palm, the finger retainers 16a to 16e are wound on the thumb and four fingers, and the hook elements 20 of the velcro fastener disposed at the free end of the ribbons of the finger retainers are pressed into union with the loop elements 18.

Then, the wrist and arm retainers 22a and 22b are wound around the wrist and forearm and the hook elements 26 of velcro fastener are similarly pressed into union with the loop elements 24. Finally, the retainer band 28 between the thumb and the index finger is paid out and passed around the wrist, and the hook element 30 of the velcro fastener at the free end of the retainer band is brought into union with the loop element 32 of velcro fastener disposed on the outer surface of the ribbon of the wrist retainer 22a.

First, the operation of the remedial device where the distribution of compressed air to the air sacks is automatically carried out by the use of solenoid valves will be described.

FIG. 4 illustrates the valves impositions where the compressed air is supplied to the air sacks for extending and expanding fingers and to the air sacks for extending a wrist and arm joint. The solenoid valves 62, 64, 72 and 73 are each provided with an air discharge port. In the state illustrated in FIG. 4, the solenoid valves 62, 72 and 73 communicate with all the air sacks via the branched circuit, and the solenoid valve 64 is provided with a suction port which communicates with the ambient air. Subsequently, when the solenoid valve 64 is actuated and the compressed air supply source 60 is set into operation, the ambient air is introduced via the solenoid valve 64 and compressed by the air supply source 60. The compressed air of the prescribed pressure is advanced through the solenoid valve 62 and air supply-discharge hoses 66, 70 and 71 to the solenoid valves 72 and 73. The compressed air which has passed through the solenoid valve 72 is forwarded via the plug 76, introduced through the air conduits 54 and 56 into the first air sacks 36a and 36b and second air sack 44, and used for inflating these air sacks and causing the thumb, index finger, middle finger, ring finger and little finger to be extended and, at the same time, spread out in the lateral direction. At the same time, the compressed air which has passed through the solenoid valve 73 is forwarded via the plug 77 and introduced through the air conduit 58 into the third air sack 50. By the consequent inflation of the third air sack 50 accommodated in the first and second pockets 40a and 40b, these pockets are folded in the shape of spread V. As a result, the wrist is bent backward toward the upper side of the hand and the wrist joint and arm joint are extended.

The darts 42a and 42b which are formed on the back side of the palmate cloth part 12 of the basal cloth 10 aid in the motion of extending the wrist joint and arm joint. In this manner, the extension of the fingers, wrist and arm joints and the expansion of the hand and fingers of the patient suffering from functional paralysis are passively effected.

When the solenoid valves 62 and 64 are simultaneously switched after the air sacks have been retained in the inflated state for a prescribed time, the compressed air generated by the compressed air supply source 60 is discharged via the solenoid valve 62 and the compressed air filling the air sacks 36a, 36b, 44 and 50 to their inflated state is aspirated by the compressed air supply source 60 via the solenoid valve 64. Thus, the discharge of air from the air sacks is forcibly carried out by the solenoid valve 62 and the air sacks are caused to resume their pressure-free state. As a result, the extension of the fingers, wrist and arm joint and the expansion of the hand and fingers are completed.

For the discharge of the compressed air described above to be effected spontaneously, the solenoid valves 72 and 73 are switched and the air sacks 36a, 36b, 44 and 50 are consequently allowed to communicate with the ambient air via the air discharge ports of the solenoid valves. By repeating the operation described above, the exercise for remedying the functions of fingers, etc. is repeated.

The method for the use of the remedial device described above is aimed at eliminating the functional disorders of paralytic bend, contraction, extension, etc. of wrist, fingers, hand and arm joint by inflating and shrinking all the air sacks and consequently extending the wrist, fingers and arm joint and expanding the hand and fingers. In the case of a patient whose functional disorders of paralytic bend, contraction, extension, etc. do not affect all the wrist, fingers and arm joints, one of the solenoid valves 72 and 73 is set in the closed state as illustrated in FIG. 4 and the other in the state communicating with the ambient air so that the compressed air is supplied only to the plug 76 or only to the plug 77 and the exercise for functional remedy is carried out only on the fingers or on the wrist or arm joint whichever requires the remedy. Of course, also in this case, the forced discharge can be effected by the action of the compressed air supply source 60 through the solenoid valve 64. Otherwise, the discharge may be attained spontaneously by switching the solenoid valve 72 or 73.

Now, the operation of the remedial device where the distribution of the compressed air to the air sacks is manually effected by means of the switch valves will be described.

FIG. 5 illustrates the switch valve for effecting the supply and discharge of the compressed air for both the air sacks used for extending and expanding the fingers and the air sacks used for extending the hand, wrist and arm joint. The flow inlet 89 is connected to the compressed air supply source 60, the flow outlet 88a to the air conduit 58, and the flow outlet 88b to the air conduits 54 and 56.

At this time, since the rotary member 92 assumes the positional relation illustrated in FIG. 6(*a*), the compressed air introduced through the flow inlet 89 into the flow path 91 is advanced from the through hole 95a to the air conduit 58 sequentially via the through hole 83a, communicating tube 84 and flow outlet 88a. At the same time, the compressed air emanating from the through hole 95b communicating with the flow path 91 is advanced to the air conduits 54 and 56 sequentially via the through hole 83b, empty chamber 86 and flow outlet 88b. As a result, the supply and discharge of the compressed air is effected for all the first, second and third air sacks. The exercise for remedying the functions of fingers, etc., which is attained when the supply and discharge of the compressed air is effected for each of the air sacks, is the same as that which is attained when the supply and discharge is attained by means of the solenoid valve mentioned above.

Where the functional disorders are such that the compressed air is not required to be supplied to or discharged from the first air sacks 36a and 36b and the second air sacks 44 for extending and expanding fingers, the handle 100 is only required to be clockwise rotated through an angle of 90 degrees to the position as shown in FIG. 6(*b*). In this case, the compressed air inside the flow path 91 advances from the through hole 95c to the air conduit 58 sequentially via the through hole 83a, communicating tube 84 and flow outlet 88a. Since the through holes 95a and 95b are kept closed with the closed end 82 of the stationary member 80, no compressed air flows into the empty chamber 86, flow outlet 88*b* or air conduits 54 and 56.

When the third air sacks for extending the wrist and arm joint do not require supply of compressed air, the handle 100 has only to be counterclockwise rotated through an angle of 90 degrees to the position as shown in FIG. 6(*c*). In this case, since the communicating tube 84 is closed and the empty chamber 86 is open, the compressed air is supplied only to the air conduits 54 and 56 via the flow outlet 88*b*.

For the discharge, similarly to the switch distribution means, the solenoid valves 62 and 64 are switched so that the compressed air filling the air sacks 36*a*, 36*b*, 44 and 50 is forcibly introduced through the discharge port of the solenoid valve 64 into the compressed air supply source 60 and forcibly discharged via the solenoid valve 62.

After the supply and discharge of the compressed air is repeated as described above for a required length of time and the exercise described above is completed, the remedial device is removed from the patient's hand by opening the velcro fasteners of the finger retainers 16*a* to 16*e* and the wrist and arm retainers 22*a* and 22*b*.

This invention concerns a remedial device for hand insufficiency which comprises a device body provided on each of the obverse and reverse surfaces thereof with a plurality of air sacks inflated and shrunken by the action of compressed air supplied and discharged for expanding and elongating such dys-functional sites as fingers, hands, wrists and arms, a compressed air source and an air supply-discharge hose interconnecting the device body and the compressed air source. In this remedial device, the air supply-discharge circuit constituted by the air supply-discharge hose is provided with branched circuits for compressed air disposed independently on the air supply-discharge side for the air sacks for elongating and expanding fingers and on the air supply-discharge side for the air sacks for elongating wrists and arm joints, and the branched circuits are separately provided with switch distribution means for selectively supplying or discharging compressed air to and from either or both of the circuits. This remedial device, therefore, enables the exercise for extending and expanding fingers and the exercise of extending a wrist, arm joint, etc. to be carried out either separately or simultaneously. It has an effect of providing delicate treatments for the elimination of various functional disorders of fingers, etc.

What is claimed is:

1. A remedial device for hand insufficiency, comprising:

a device body having a back surface provided thereon with a plurality of sacks inflatable and shrinkable by the action of compressed air supplied thereto and discharged therefrom for laterally spreading and straightening the bend of fingers on a hand, and a palm and wrist surface provided thereon with a further plurality of sacks separately inflatable and shrinkable from said first-mentioned plurality of sacks by the action of compressed air supplied thereto and discharged therefrom for bending the hand back around a wrist joint;

a first air supply-discharge hose means connected to the air sacks for laterally spresding and straightening the bend of the fingers for supplying air thereto and discharging air therefrom, and a second air supply-discharge hose means connected to the air sacks for bending the hand back around the wrist joint for supplying air thereto and discharging air therefrom;

an air compressor;

a compressed air supply conduit means extending from said compressor and having a branched conduit means extending from the downstream end thereof to the respective air supply-discharge hose means; and air supply valves for each of said branched conduit means operable for alternately permitting supply of air to the respective air supply-discharge hose means and blocking supply of air to the respective air supply-discharge hose means while connecting said air supply-discharge hose means to atmosphere, and an air supply control valve in said compressed air supply conduit means movable to an open position for permitting supply of air to said branched conduit means and to a closed position for blocking supply of air to said branched conduit means and permitting discharge of air from said compressor to atmosphere, and an air discharge control valve in said compressed air supply conduit means movable to a closed position for blocking return of air from the respective air supply-discharge hose means to said compressor and opening to the atmosphere to supply atmospheric air to the upstream end of said compressor when said air supply control valve is in the open position, and movable to an open position for permitting return of air from said supply-discharge hose means to said compressor when said air supply control valve is in the closed position; whereby said air supply control valve and said air discharge control valve and said air supply valves can be operated for supplying compressed air through said branched conduit means to all of said air sacks or to only the air sacks for laterally spreading and straightening the bend of the fingers or the air sacks for bending the hand back, and for discharge of air from the sacks to said branched conduit means and to the atmosphere, or for returning discharging air from said branched conduit means to said compressor for exerting suction on said sacks.

2. A remedial device as claimed in claim 1 in which said air supply control valves for said branched conduit means comprise a three way manual valve connected at upstream ends of said branched conduit means and operable to open or close either or both of said branched conduit means.

3. A remedial device as claimed in claim 1 in which said air supply valves comprise a separate air supply valve in each branched conduit of said branched conduit means, and each air supply valve being movable between a first position in which compressed air can be supplied to the sacks to which the corresponding branched conduit supplies compressed air, and a second position in which compressed air from the sacks can be discharged to the atmosphere, whereby when the air supply valves are in the first position, compressed air can be supplied or suction can be exerted through the respective branched conduit, and when the air supply valves are in the second position, air can be discharged from the sacks to the atmosphere.

* * * * *